United States Patent [19]

Meisner, et al.

[11] Patent Number: 4,588,876

[45] Date of Patent: May 13, 1986

[54] ARRANGEMENT FOR THE SUPPORT OF A PROGRAM PLATE

[75] Inventors: Alfred Meisner, Nurnberg; Horst Grimmer, Nurnberg-Oberas; Alfred-Gunther Lunz, Nurnberg, all of Fed. Rep. of Germany

[73] Assignee: Diehl GmbH & Co., Nurnberg, Fed. Rep. of Germany

[21] Appl. No.: 615,134

[22] Filed: May 30, 1984

[30] Foreign Application Priority Data

Jun. 15, 1983 [DE] Fed. Rep. of Germany ..... 3321540

[51] Int. Cl.[4] ..... H01H 43/10; G04F 8/00

[52] U.S. Cl. ..... 200/35 R; 200/38 D; 368/108

[58] Field of Search ..... 200/35 R, 36 R, 37 R, 200/37 A, 38 R, 38 FA, 38 B, 38 D, 38 DA; 368/107-113

[56] References Cited

U.S. PATENT DOCUMENTS 3,937,910 2/1976 Fukami ..... 200/35 R 4,509,864 4/1985 Oellig et al. ..... 200/38 D X

FOREIGN PATENT DOCUMENTS 2408581 8/1975 Fed. Rep. of Germany .

*Primary Examiner*—J. R. Scott

*Attorney, Agent, or Firm*—Scully, Scott, Murphy & Presser

[57] ABSTRACT

An arrangement for the support of a program plate, preferably for a timer, including a bottom plate with a support sleeve fastened thereto and which is preferably integrally formed with the bottom plate; in which the outer surface of the support sleeve forms a rotary bearing for a hub of the program plate. The bottom plate includes a hole breakthrough which forms a guide for a drive take-off pinion of a driving mechanism for the program plate which is located below the bottom plate, and wherein the bottom plate is so recessed in the region of the support sleeve in a direction towards the driving mechanism, as to form a hollow depression. The support sleeve is constructed as a guide conduit whose outer surface, in connection with an inner surface of a tubular hub of the program plate which is open towards both sides thereof, forms a rotary bearing; wherein an inner surface of the guide conduit is provided for the receipt of a locking bolt. The locking bolt possesses an enlarged section at its outer end which radially overhangs the guide conduit; and in which the program plate is, preferably, axially guided between a lower stop located at the end of the guide conduit facing the bottom plate and the enlarged section of the locking bolt.

15 Claims, 1 Drawing Figure

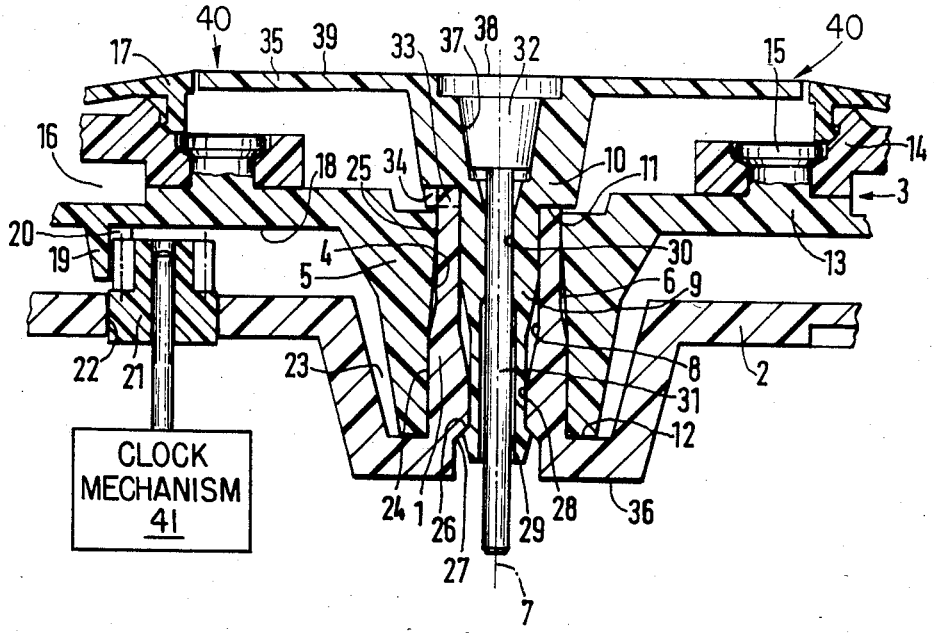
40
35
39
33
37
38
32
40
17
15
16
14
18
25
34
10
11
3
20
19
4
30
13
5
6
9
22
21
23
8
2
31
12
CLOCK
MECHANISM
41
24
1
26
29
28
36
27
7

ARRANGEMENT FOR THE SUPPORT OF A PROGRAM PLATE

BACKGROUND OF THE INVENTION

1. Field of the Invention

The present invention relates to an arrangement for the support of a program plate, preferably for a timer, including a bottom plate with a support sleeve fastened thereto and which is preferably integrally formed with the bottom plate; in which the outer surface of the support sleeve forms a rotary bearing for a hub of the program plate; wherein the bottom plate includes a hole therethrough which forms a guide for a drive take-off pinion of a driving mechanism for the program plate which is located below the bottom plate, and wherein the bottom plate is so recessed in the region of the support sleeve in a direction towards the driving mechanism, as to form a hollow or depression.

2. Discussion of the Prior Art

Arrangements of the foregoing kind are generally known in the art. Thus, from the disclosure of German Laid-open Patent Application No. 24 08 581 there can ascertained a timer with a program plate which is supported on a support sleeve. The support sleeve is hereby fixedly applied on a bottom plate, which restricts the space available for the driving mechanism in a direction towards the program plate. In the region of the base of the support sleeve, the bottom plate is recessed in the direction towards the driving mechanism so as to form a hollow depression about the support sleeve. In the area of this hollow depression, the bottom plate incorporates a hole therethrough for a drive take-off pinion of the driving mechanism which operates the program plate through a gear unitarily connected with the program plate.

However with regard to the kind of security against any axial displacement of the program plate on the support sleeve, nothing is disclosed in German OS No. 24 08 581. Nevertheless, it is quite apparent, that there must be provided such a securing arrangement. The location of such securing arrangement below the program plate in the region of the hollow depression is, however, subject to considerable problems inasmuch as any accessibility thereto is extremely restricted. When, in contrast therewith, there is employed as a securing arrangement a form-fitted locking device which is effective in one direction, for the support of the program plate, then it is no longer possible to provide for the non-destructive disassembling of the program plate, or only possibly with the use of a suitable specialized worktool.

Additionally, in a construction pursuant to, German OS No. 24 08 581, because of the formation of a hollow depression which extends essentially over the diameter of the program disc, and which appreciably reduces the space available for the driving arrangement, leads to an increase in the constructional height of the timer.

A further problem which is encountered in timers which are constructed in that manner, when they are to be utilized as built-in components which, when required by the assembly, on the side of the surface of the bottom plate facing the program plate, the marking applied thereon for the recognition of the rotational position of the program plate is covered. Consequently, a new marking must be provided on the apparatus into which the timer is built-in, at a definite location; in essence, coinciding with the applicable switching points of the program plate in order to achieve a correlation between the switching points and with the set actual time.

SUMMARY OF THE INVENTION

Accordingly, it is an object of the present invention to so construct the support for a program plate as to facilitate an easier assembly and disassembly of, preferably, the complete program plate. Furthermore, the support arrangement should be as compact as possible; in essence, the space for the driving arrangement should be restricted as little as possible by the support for the program plate. Furthermore, there should be afforded the capability that the indexing or characterization for the rotational position of program plate is so applied that it will not be covered upon the assembly of the timer.

In order to achieve the foregoing object, in an arrangement for the support of a program plate as described herein, the support sleeve is constructed as a guide conduit whose outer surface, in connection with an inner surface of a tubular hub of the program plate which is open towards both sides thereof, forms a rotary bearing; wherein an inner surface of the guide conduit is provided for the receipt of a locking bolt, with the locking bolt possessing an enlarged section at its outer end which radially overhangs the guide conduit; and in which the program plate is, preferably, axially guided between a lower stop located at the end of the guide conduit facing the bottom plate and the thickening on the locking bolt.

In order to attain the foregoing object, due to the axial guidance of the program plate between a lower stop which is connected with the driving component and an upper stop on the locking bolt, there is achieved an extremely low constructional height. Furthermore, the complete switch disc can then be mounted on the already finished driving component in the simplest manner, and fastened by means of the locking bolt. In the same manner is it possible to provide for the disassembling by removing of the locking bolt. Finally, the space below the program plate, which is necessary for the support, can be minimized inasmuch as, for the disassembling of the program plate, no accessibility is required any longer. This is particularly valid when, in a preferred manner, the bottom plate is recessed hollow-like in the region of the support sleeve. For the hollow recess there is then merely required such a size, to allow for insertion of the hub of the program plate with a small play.

Through the configuration of the outer surface of the guide conduit and/or the inner surface of the hub of the program plate, only a portion of the surfaces are used as a rotary bearing. Consequently, the resistance to rotation caused by bearing friction is significantly reduced. Concurrently, through the preferred configuration of the bearing surfaces at the two ends of the hub, or the guide conduit, there is no reduction in the guidance stability, in effect, the tendency of the program plate towards wobbling will not increase notwithstanding the reduced bearing friction.

Through the reduction in the outer diameter of the guide conduit and of the inner diameter of the hub outwardly in the axial direction, the mounting of the program plate is rendered appreciably easier, so that upon the applying of the program plate, its hub side will contact with the largest diameter thereof against the end of the guide conduit having the smallest diameter.

Through the outwardly funnel-shaped widening of the inner surface of the guide conduit, it is possible to attain a simple insertion for the locking bolt into the guide conduit. Thereby, the locking bolt incorporates resilient projections at its end facing towards the drive in a preferred embodiment thereof, which are compressed upon insertion of the locking bolt into the guide conduit in order to fixedly arrest the locking bolt in the inserted position, in that they will spring back into a conical widening of the inner surface of the guide conduit towards into their original position, and then so engage behind the cone so that the locking bolt is restrained in this position. The elasticity of these projections are hereby preferably achieved in that the locking bolt is slotted along the axial direction in the region of the projections.

In an advantageous manner the locking bolt is so constructed that it possesses a somewhat conically extending outer surface, independently of the enlarged section, and is initially inserted with the smaller side into the guide conduit. Hereby, preferably the shape of the inner surface of the guide conduit and the shape of the locking bolt are so correlated with respect to each other, whereby the locking bolt will only contact against the smallest location the guide conduit (between the funnel-shaped widening and the cone) and at the outer end of the guide conduit against the inner surface thereof. This construction does not necessitate the highest degree of dimensional accuracy, for the locking bolt and the inner surface of the guide conduit; while, nevertheless, for the guidance of the program plate between the enlarged section and the lower stop of the locking bolt, there is achieved an adequate precision.

In a further preferred embodiment, the locking bolt possess an axially oriented through-extending hollow space, which is adapted for the receipt of a securing pin. The securing pin hereby renders immovable the resilient projections on the locking bolt, so that after the introduction of the securing pin, the locking bolt can no longer be withdrawn. The securing pin is here preferably formed in the shape of a nail, wherein the head serves as the guide stop during insertion. Thereby, the external surface of the enlarged section of the locking bolt can be so constructed that the nail head is completely insertable, and there is formed a smoothly extending surface so that the securing pin cannot be inadvertently moved or at all withdrawn.

In order to, nevertheless, allow for an easy dismounting of the program plate, the securing pin is advantageously so constructed that in the inserted condition thereof it will project beyond the end of the guide conduit at the driving end, or beyond the surface of the bottom plate facing the drive. The securing pin can be slid out to such an extent from the locking bolt for the dismounting of the program plate so that it can be withdrawn further from above.

In a further advantageous embodiment, the locking bolt is designed so as to be secured against rotation with respect to the guide conduit, and thereby also with respect to the bottom plate. Through this measure, it is possible to provide markings on the exterior surface of the enlarged section of the locking bolt which projects from the hub of the program plate, and which indicate the current angular position of the program plate. Preferably a cover plate can hereby be secured on the locking bolt fixed against rotation; for example, integrally constructed with the locking bolt, which covers the inner portion of the switch disc as a protector, and which carries a marking on its outer surface which directly corresponds with a scale provided on the program plate.

BRIEF DESCRIPTION OF THE DRAWING

Further advantages and features of the invention may now be ascertained from the following detailed description of an exemplary embodiment of the invention, taken in conjunction with the single FIGURE of the accompanying drawing, illustrating a cross-section through a supporting arrangement for the program plate of a timer.

DETAILED DESCRIPTION

The supporting arrangement consists of a support sleeve which is constructed as a guide conduit 1 which is fastened on a bottom plate 2, and preferably is constructed integrally therewith of plastic material.

Supported on this guide conduit 1 is an essentially circular program plate 3 in such a manner whereby an inner surface 4 of a tubular hub 5 which is open towards both ends thereof and which is centrally arranged in the program plate 3, forms a rotary bearing in cooperation with an outer surface 6 of the guide conduit 1, by means of which the program plate 3 is rotatable relative to the bottom plate 2 about an axis of rotation 7 located in the geometric centerpoint of the annular surface of the program plate 3. An inner surface 8 of the guide conduit 1 is designed for the receipt of a locking bolt 9 which includes an enlarged section 10 at its top or outer end (opposite the direction of the bottom plate 2), which radially overhangs the guide conduit 1 and which forms an upper stop 11 for the hub 5 of the program plate 3. The hub 5 is hereby axially guided and retained between a lower stop 12, which is preferably formed by the bottom plate 2, and its upper stop 11, and possesses almost the same length, providing a necessary bearing play, as the guide conduit between the lower and upper stops 12, 11.

The program plate 3 is preferably constructed of multiple components; it consists of a round plate support 13 which is connected with the hub 5 so as to be secured against rotation relative thereto, and is preferably formed integrally therewith of a plastic material. The hub 5 forms a right angle with the surface of the plate carrier 13, and is preferably longer than the thickness of the plate carrier 13 in order to obtain a sufficient degree of stability of the rotary bearing to prevent any tilting of the program plate 3. Externally (in the direction opposite the bottom plate 2), there is centrally fastened on the plate carrier 13, which forms the basis for the additional buildup of the program plate 3, a circular spring disc 14, preferably by means of rivet joint 15. Provided towards the outer circumference of the program plate 3 is, preferably, a hollow space 16 between the plate carrier 13 and the spring disc 14 which, together with other usual constructional features on the program plate 3, serves for the receiving and guidance of riders or slide contacts; the slide contacts as well as these other usual constructional features on the program plate 3 are not illustrated in the drawing since they can be of any suitable configuration for the invention. On the spring disc 14 there can be, preferably, provided a marking in correspondence with the slide contacts; for instance, also in the form of a raised scale ring 17 which is secured against rotation.

On a lower surface 18 of the plate carrier 13, which faces towards the bottom plate 2, in a preferred manner there is provided an annular projection 19 which has teeth 20 on the side facing towards the axis of rotation 7, which interengages with corresponding teeth on a drive takeoff pinion 21 of a clockwork mechanism 41 which is located below the bottom plate 2 in a usual manner.

The bottom plate 2 is provided with a hole 22, in which there is positioned the drive takeoff pinion 21. Furthermore, the plate is recessed in such a manner in the region of the guide conduit 1, so as to form a hollow cavity 23 extending about the guide conduit 1, whose volume is such that the hub 5 of the program plate 3 can be inserted with a play which is provided for production. The depth of the hollow cavity 23 is preferably so dimensioned that the lower side 18 of the plate carrier 13, or the annular projection 19 on the lower side 18, will not contact the bottom plate 2.

In a preferred embodiment of the bearing or supporting arrangement, the outer surface 6 of the guide conduit 1 and/or the inner surface 4 of the hub 5 of the program plate 3 is at least partly concavely curved. This curvature is presently located approximately in the middle of the axial extension of the guide conduit 1, or the hub 5. In this region, the outer surface 6 and the inner surface 4 will not contact each other; in effect, the surfaces of. the rotary bearing are presently limited to an inner bearing surface 24 facing towards the drive, and an outer bearing surface 25 at both ends of the guide conduit 1. Due to this measure, the bearing friction, which is essentially proportional to the size of the bearing surface, is significantly reduced, without adversely affecting the guidance of the hub 5 on the guide conduit 1.

Furthermore, it is especially advantageous when the outer surface 6 of the guide conduit 1, or the inner surface 4 of the hub 5 outwardly, in essence, opposite to the direction of the bottom plate 2, are reduced in their diameter, since this will facilitate the mounting of the program plate 3. The inner surface 8 of the guide conduit 1, in a preferred embodiment of the supporting arrangement, possesses differing diameters along its axial length. Thus, the inner surface 8 of the guide conduit 1 widens funnel-like towards the outside (opposite the direction to the bottom plate 2), in order to facilitate the insertion of the locking bolt 9. Furthermore, the inner surface 8 of the guide conduit 1 can be conically 27 at its end towards the bottom plate, so that resilient projections 26 can be preferably arranged on the locking bolt 9 which, in a latched position of the locking bolt, engage behind this cone 27 and thereb hold or arrest the locking bolt 9 in the latched position thereof.

The resiliency of the projections 26 can be achieved, for example, in that the end of the locking bolt 9 towards the bottom plate is provided with an axially oriented slot 29 which extends approximately over one-half of the length of the locking bolt 9. The width of the slot is hereby so selected the projections 26, pressed-together at the slot 29, pass through the interior of the guide conduit 1. Preferably, the locking bolt 9 is hereby essentially conically constructed, and namely, in such a manner that it will contact against the smallest point 28 of the guide conduit 1, (relative to the diameter of the inner surface 8) and also at the external end of the inner surface 8 of the guide conduit 1.

In an advantageous embodiment of the supporting arrangement, the locking bolt 9 possesses an axially oriented, through-extending hollow space 30 which is provided for the receipt of a securing pin 31. By means of the securing pin 31, the resilient projections 26 on the locking bolt 9 are rendered immovable, so that the locking bolt 9 which has been brought into its latched position can no longer be removed from this latched position in the presence of the inserted securing pin 31.

The rendering of the projections 26 immovable is effected, for instance, in that the securing pin reaches into the region of the slot 29 and thus prevents any pressing-together of the slot. The securing pin 31 is preferably constructed nail-shaped with a head 32 which, upon the insertion of the securing pin 31 into the locking bolt 9, serves as a guide stop. The securing pin 31 is retained in the hollow space 30 of the locking bolt only through a slight clamping friction which will essentially prevent the securing pin 31 from falling out during jarring or unfavorable physical positioning of the program plate 3.

In a further preferred embodiment of the supporting arrangement, the locking bolt 9 is secured against rotation relative to the guide conduit 1. This is achieved in that the outer end of the guide conduit 1 includes a projection 33 which corresponds with a groove 34 in the enlarged section 10 of the locking bolt 9. The locking bolt 9 is thusly insertable only in a definite angular position up to the latched position into the guide conduit 1. As a result, the locking bolt 9 is also positioned so as to be secured against rotation relative to the bottom plate 2 and is thereby adapted to form a supporting point for a marking for the identification of the current angular position of the program plate 3. Preferably, at the enlarged section 10 of the locking bolt 9 there is centrally arranged an essentially circular cover plate 35, or formed integrally with the thickening 10 and thereby also with the locking bolt 9. The cover plate 35 covers the middle portion of the program plate 3, preferably up to the scale ring 17, as a protection against mechanical damage and dirt. On the upper surface of the cover plate 35, proximate the scale ring 17 there can be provided markings 40 for identification of the angular position of the program plate 3. This marking, in contrast with a marking applied on the bottom plate, is not covered upon the building in of the timer into a housing.

The length of the securing pin 31 can be advantageously so selected, that in the inserted condition of the pin, it will project from the lower end of the locking bolt 9 towards the bottom plate, preferably by a lower surface 36 of the bottom plate 2 towards the drive. At a suitable configuration of the clockwork mechanism (not shown) for the program plate 3, the securing pin 31 can be slid out from below to such an extent from the locking bolt 9, so that it can be completely withdrawn without difficulty from the outside (from the outer side of the program plate 3). There is thus provided a simple disassembling capability for the program plate 3.

The head 32 of the securing pin 31 is preferably so shaped that it is completely insertable into a correspondingly shaped depression 37 in the enlarged section 10 of the locking bolt 9, or in the cover plate 35. Hereby, an upper surface 38 of the head 32 should form an essentially coplanar surface with an external surface 39 of the cover plate 35, which is either planar or unitarily curved. This will prevent the securing pin 31 from being withdrawn from the locking bolt 9 by an unauthorized person.

What is claimed is:

1. In an arrangement for the support of a program plate, such as for a timer, including a bottom plate having a support sleeve fastened thereto, wherein the outer surface of said support sleeve forms a rotary bearing for a hub of said program plate, said bottom plate having an opening therethrough forming a guide for a drive pinion of a driving mechanism for the program plate, said driving mechanism being located below the bottom plate, and wherein the bottom plate is recessed in the region of the support sleeve in the direction towards the driving mechanism so as to form a cavity; the improvement comprising: said support sleeve being in the shape of a guide conduit; said hub being tubular and open-ended, said guide conduit having the outer surface thereof in contact with the inner surface of said hub to thereby form a rotary bearing; a hollow locking bolt being received in an inner surface of the guide conduit, said locking bolt having an enlarged section at its outer end radially overhanging the guide conduit; and wherein the program plate is axially guided between a lower stop at the end of the guide conduit facing the bottom plate and the enlarged section on the locking bolt.

2. Arrangement as claimed in claim 1, wherein said support sleeve is integrally formed with said bottom plate.

3. Arrangement as claimed in claim 1, wherein the outer surface of said guide conduit is partly concavely curved in the axial direction, wherein the hub of said program plate is only supported on a portion of the outer surface of the guide conduit at both ends of the guide conduit.

4. Arrangement as claimed in claim 1, wherein one inner surface of the hub of said program plate is partly concavely curved in the axial direction, wherein the inner surface of the hub is supported on only a portion of the outer surface of the guide conduit at both ends of the hub.

5. Arrangement as claimed in claim 1, wherein the outer diameter of the guide conduit and the inner diameter of the hub reduce outwardly in the axial direction.

6. Arrangement as claimed in claim 1, wherein the inner surface of the guide conduit widens funnel-shaped towards the outside.

7. Arrangement as claimed in claim 1, wherein the inner surface of the guide conduit widens into a cone shape at the end facing the bottom plate; and resilient projections on said locking bolt are latched on said cone shape in the latched position of said locking bolt.

8. Arrangement as claimed in claim 6, wherein said locking bolt has a substantially conical shape and contacts the inner surface of said guide sleeve conduit at the narrowest point of the guide conduit and at an external end of the guide conduit.

9. Arrangement as claimed in claim 7, wherein the end of the locking bolt towards the bottom plate side is slotted in the axial direction.

10. Arrangement as claimed in claim 7, wherein the locking bolt includes an axially oriented, through extending hollow space; a nail-shaped securing pin being received in said hollow space whereby the resilient projections on said locking bolt are rendered immovable in the latched position of said bolt.

11. Arrangement as claimed in claim 7, wherein the guide conduit includes a projection at the external end thereof, a groove in the enlarged section of the locking bolt conforming with said projection, and wherein the locking bolt is insertable in only one predetermined angular position into its latched position through cooperation between the groove and the projection.

12. Arrangement as claimed in claim 11, wherein a cover plate covers a portion of the program plate, said cover plate being fixed to the enlarged section of the locking bolt and being secured against rotation relative thereto, and wherein the cover plate includes a marking for identifying the angular position of the program plate.

13. Arrangement as claimed in claim 12, wherein said cover plate is integrally formed with said locking bolt.

14. Arrangement as claimed in claim 10, wherein the securing pin in the inserted condition thereof projects beyond the end of the locking bolt towards the bottom plate, and beyond the surface of the bottom plate towards the driving mechanism.

15. Arrangement as claimed in claim 14, wherein the securing pin has an outwardly extending head shaped to be fully insertable in a correspondingly shaped recess in said enlarged section, and an upper surface of the head forming a substantially planar or unitarily curved surface with an external surface of said enlarged section.

* * * * *